US007187888B2

(12) United States Patent
Curynski et al.

(10) Patent No.: US 7,187,888 B2
(45) Date of Patent: Mar. 6, 2007

(54) CORONA GENERATING DEVICE HAVING A WIRE COMPOSITE

(75) Inventors: Martin J. Curynski, Webster, NY (US); Dhirendra C. Damji, Webster, NY (US); Bruce A. Dangelmaier, Henrietta, NY (US); Karl E. Kurz, Rochester, NY (US); Arthur F. McLean, Webster, NY (US)

(73) Assignee: Xerox Corporation, Stamford, CT (US)

( * ) Notice: Subject to any disclaimer, the term of this patent is extended or adjusted under 35 U.S.C. 154(b) by 101 days.

(21) Appl. No.: 10/812,685

(22) Filed: Mar. 30, 2004

(65) Prior Publication Data

US 2005/0220492 A1 Oct. 6, 2005

(51) Int. Cl.
*G03G 15/02* (2006.01)

(52) U.S. Cl. ..... 399/170

(58) Field of Classification Search ..... 399/170
See application file for complete search history.

(56) References Cited

U.S. PATENT DOCUMENTS

| | | | | |
|---|---|---|---|---|
| 4,086,650 | A | 4/1978 | Davis et al. | 361/229 |
| 4,533,230 | A * | 8/1985 | Fletcher et al. | 399/173 |
| 4,910,360 | A * | 3/1990 | Lee | 174/117 F |
| 5,756,998 | A * | 5/1998 | Marks et al. | 250/324 |

* cited by examiner

*Primary Examiner*—Quana Grainger
(74) *Attorney, Agent, or Firm*—Lloyd Bean, II

(57) ABSTRACT

A charging device including a coronode having a wire composite including a core having a dielectric material and a coating layer of conduct material thereon.

10 Claims, 2 Drawing Sheets

CORONA GENERATING DEVICE HAVING A WIRE COMPOSITE

BACKGROUND AND SUMMARY

The present invention relates generally to a corona device primarily for use in reproduction systems of the xerographic or dry copying type, more particularly, concerning the utilization a wire composite coronode to extend the charging capabilities of scorotrons.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate to create an image which may be permanently affixed to the image support substrate, thereby providing an electrophotographic reproduction of the original document. In a final step in the process, the photoconductive surface of the photoreceptive member is cleaned to remove any residual developing material which may be remaining on the surface thereof in preparation for successive imaging cycles.

Thin metal wires coated with glass, glass-ceramic, or other dielectric materials have been shown to have many different uses in various fields of technology, for example: in the electrical and electronic fields, as conductors, microthermocouples, resistors, and heaters; in the medical field as micro-electrodes; and in the field of composite materials as reinforcing elements and as conductors of electricity and/or heat in ceramic masses. In one specific application, glass coated wire composites have been shown to be useful in corona generating devices, as used in various technologies that require the generation of ions to produce certain gases or to create electrostatic charges.

In particular, a typical electrostatographic printing system utilizes a corona generating device for depositing an initial uniform electrostatic charge on a photoconductive surface. This charge is subsequently selectively dissipated by exposure to an optical signal for creating an electrostatic latent image on the photoconductive surface which may then be developed and the resultant developed image can be transferred to a copy substrate, thereby producing a printed output document. Such corona generating devices are also utilized in electrostatographic printing applications to perform a variety of other functions, such as: transferring the developed image to the output copy substrate; electrostatically tacking and de-tacking the copy substrate with respect to the photoconductive surface; conditioning the image bearing photoconductive surface prior to, during and after development of the image thereon to improve the quality of the output image; and cleaning of the photoconductive member.

Of particular interest with respect to the present invention, is a so-called "dicorotron" type of corona generating device, as first disclosed in U.S. Pat. No. 4,086,650, issued to Davis et al. A dicorotron comprises a corona generating electrode member located adjacent a conductive shield, wherein the electrode member is a thin conductive wire coated with a dielectric material, preferably glass. Davis et al. found that the use of a glass coated corona generating electrode solved many problems associated with prior art corona charging devices utilizing an uncoated thin wire electrode. Most significantly, the charge deposited by a glass coated wire corona generating device is substantially more uniform than the charge deposited by bare wire corona generating devices.

Several problems have been historically associated with such corona devices. One major problem has been their inability to deposit a relatively uniform negative charge on an imaging surface due to surface irregularities of the corona wire. Another problem has been the growth of chemical compounds on the coronode which eventually degrades the operation of the corona device. Yet another problem has been the degradation in charging output resulting from toner accumulations on the coronode and surrounding shield structure. One still further problem is wire vibration which leads to arcing and wire fracture. These problems, among others, are specifically addressed in the aforementioned applications in which there are proposed novel corona discharge configurations which substantially reduce or alleviate the problems noted above, and other problems associated with prior art corona devices, as is discussed more fully therein.

Additional and other aspects of the present invention will become apparent as the following description proceeds and upon reference to the drawings, in which.

For a general understanding of the features of the present invention, reference is made to the drawings, wherein like reference numerals have been used throughout to designate identical elements.

Figure 3:
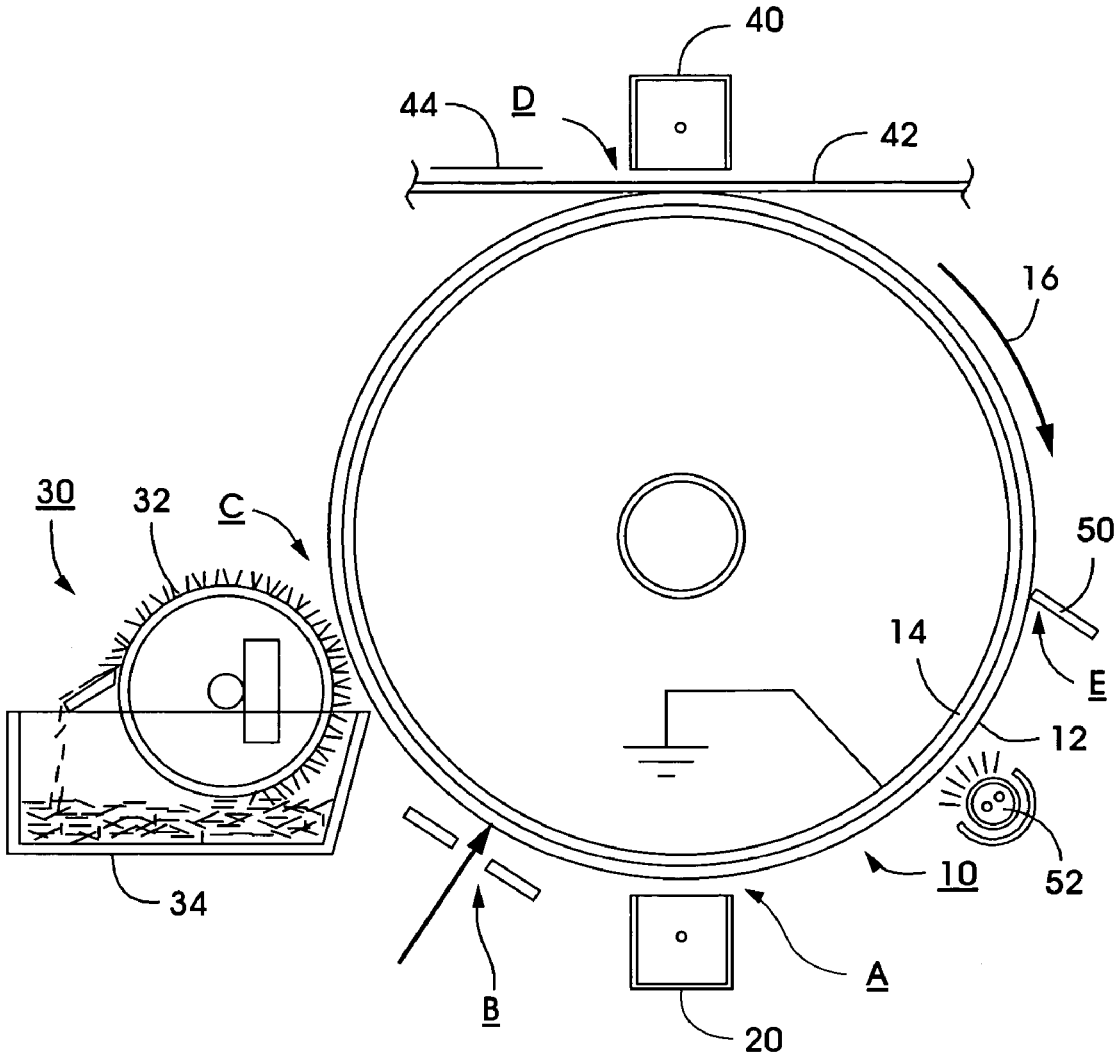
FIG. 3 is a schematic view showing an electrophotographic copying apparatus employing at least one corona generating device.

Referring initially to FIG. 3, prior to describing the specific features of the present invention, a schematic depiction of the various components of an exemplary electrophotographic reproducing apparatus incorporating the corona generating assembly of the present invention is provided. Although the apparatus of the present invention is particularly well adapted for use in an electrophotographic reproducing machine, it will become apparent from the following discussion that the present corona generating device is equally well suited for use in a wide variety of electrostatographic processing machines as well as other systems requiring the use of a corona generating device. In particular, it should be noted that the corona generating device of the present invention, described hereinafter with reference to an exemplary charging system, may also be used in the toner transfer, detack, or cleaning subsystems of a typical electrostatographic copying or printing apparatus since such subsystems also require the use of a corona generating device.

The exemplary electrophotographic reproducing apparatus of FIG. 3 employs a drum including a photoconductive surface 12 deposited on an electrically grounded conductive substrate 14. A motor (not shown) engages with drum 10 for rotating the drum 10 in the direction of arrow 16 to advance successive portions of photoconductive surface 12 through various processing stations disposed about the path of movement thereof, as will be described. Initially, a portion of drum 10 passes through charging station A. At charging station A, a charging device, preferably of the type disclosed by the present invention, indicated generally by reference numeral 20, charges the photoconductive surface 12 on drum 10 to relatively high, substantially uniform potential. The charging device in accordance with the present invention will be described in detail following the instant discussion of the electrostatographic apparatus and process.

Once charged, the photoconductive surface 12 is advanced to imaging station B where an original document (not shown) may be exposed to a light source (also not shown) for forming a light image of the original document onto the charged portion of photoconductive surface 12 to selectively dissipate the charge thereon, thereby recording onto drum 10 an electrostatic latent image corresponding to the original document.

One skilled in the art will appreciate that various methods may be utilized to irradiate the charged portion of the photoconductive surface 12 for recording the latent image thereon as, for example, a properly modulated scanning beam of energy (e.g., a laser beam).

After the electrostatic latent image is recorded on photoconductive surface 12, drum is advanced to development station C where a development system, such as a so-called magnetic brush developer, indicated generally by the reference numeral 30, deposits developing material onto the electrostatic latent image.

The exemplary magnetic brush development system 20 shown in FIG. 3 includes a single developer roller 32 disposed in developer housing 34, in which toner particles are mixed with carrier beads to create an electrostatic charge therebetween, causing the toner particles to cling to the carrier beads and form developing material. The developer roll 32 rotates to form a magnetic brush having carrier beads and toner particles magnetically attached thereto. As the magnetic brush rotates, developing material is brought into contact with the photoconductive surface 12 such that the latent image therefrom attracts the toner particles of the developing material forming a developed toner image on the photoconductive surface 12.

It will be understood by those skilled in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 is provided for creating an electrostatic charge on the backside of sheet 42 to aid in inducing the transfer of toner from the developed image on photoconductive surface 12 to the support substrate 42.

While a conventional coronode device is shown as a charge generating device 40, it will be understood that the charging device of the present invention might be substituted for the corona generating device 40 for providing the electrostatic charge which induces toner transfer to the support substrate materials 42.

However, it will be recognized after image transfer to the substrate 42, the support material 42 is subsequently transported in the direction of arrow 44 for placement onto a conveyor (not shown) which advances the sheet to a fusing station (also not shown) which permanently affixes the transferred image to the support material 42 thereby for a copy or print for subsequent removal of the finished copy by an operator.

Often, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10.

Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp (not shown) for flooding the photoconductive surface 12 with light in order to dissipate any residual electrostatic charge remaining thereon in preparation for a subsequent imaging cycle.

The foregoing description should be sufficient for purposes of the present application for patent to illustrate the general operation of an electrostatographic reproducing apparatus incorporating the features of the present invention. As described, an electrostatographic reproducing apparatus may take the form of several well known devices of systems. Variations of the specific electrostatographic processing subsystems or processes described herein may be expected without affecting the operation of the present invention.

Figure 1:
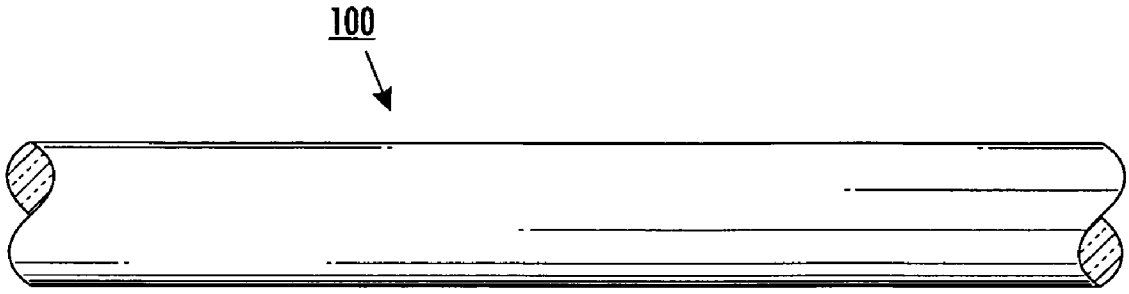
FIGS. 1 and 2 are perspective, sectional view of a gold coated fiber optic coronode wire of the present invention.
Figure 2:
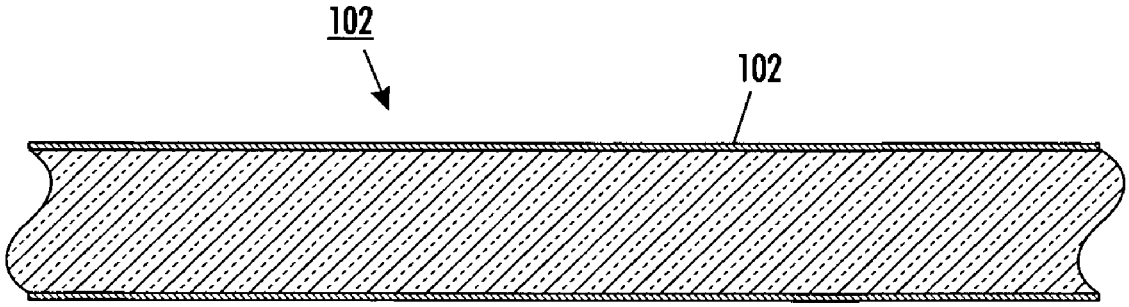

Referring initially to FIGS. 1 and 2 that are perspective, sectional view of a gold coated fiber optic coronode wire of the present invention, a coated wire composite 10 of the type used in a corona discharge electrode is shown, comprising a core wire 12, in the form of an inner dielectric material, and a conductive coating 14 of coated thereon. A typical corona discharge member as used in electrostatographic printing applications is supported in a conventional fashion at the ends thereof by insulating end blocks mounted within the ends of a shield structure. Such a mounting means is described in U.S. Pat. No. 4,086,650. When mounted in such a fashion, the corona discharge member is generally placed under a small amount of tension in order to prevent the corona discharge member from sagging during the generation of the corona so as to maintain the normally flexible corona discharge member at a precisely fixed position between the support members.

Coated wire composite 10 preferably has a tensile strength in excess of about 50,000 p.s.i. (3,500 kg/cm$^2$) and more preferably a tensile strength in excess of 90,000 p.s.i. (6,300 kg/cm$^2$). Generally, Core wire 12 is composed of a glass filament material which may have a tensile strength from about 50,000 p.s.i. (3,500 kg/cm$^2$) to about 340,000 p.s.i. (23,200 kg/cm$^2$). The present invention employs an optical fiber; one particular embodiment core wire, available from particular glass was designated by the glass code 1724, available from Corning Inc. of Corning, N.Y. The diameter of the core wire is not critical and may vary typically between about 0.003 inches to about 0.015 inches and preferably is about 0.004 inches to about 0.006 inches.

The coatings, on the other hand, designated by reference numeral 12 in FIG. 1, may be made of any conventional conductive materials. Preferably gold, exemplary conductive materials include stainless steel, gold, aluminum, copper, tungsten, platinum, molybdenum, tungsten/molybdenum alloy, carbon fibers, and the like.

There are several processes regarding how to apply coating on a surface. However, in order to be applied to glass surfaces coatings must meet several criteria: compatibility with glass properties, ability to form uniform films over large surfaces, ability to be produced economically, operating safety and environmental friendliness. Due to these restrictions, primary glass manufacturing companies today use physical vapor deposition (PVD) and chemical vapor deposition (CVD). We will be concentrating on PVD, also known as the sputtering process.

The basic PVD process works by passing an electrical current through ionized gas, thus bombarding the surface of a metal cathode with ions. The atoms of the desired metal are vaporized and then deposited in a thin film on the surface of glass. The invention of the "planar magnetron" in 1971 increased the effectiveness of the process. This is often called a 'soft coat', because the coating is more susceptible to damage than is hard coat glass when glazed in monolithic forms. Due to its fragility, this soft-coated glass has special handling and processing requirements.

An advantageous feature of the present invention is that gold coat fiber optic cable having the appropriate diameter and use as a coronode for corotrons can reduce contaminant buildup problems experienced in existing metal wire coronodes. One factor believe to approved performance is that the optic fiber has a very smooth surface and after coating it has substantially less surface irregularities than conventional metal wires which promotes less contamination and improved corona generation.

In accordance with the present invention, there has been described an improved method for manufacturing a coated wire composite material satisfying the aspects set forth hereinabove. The process described herein has been found to be particularly useful in the production of coated wire for use in dicorotron type corona generating devices utilized in electrostatographic printing systems.

The present invention, therefore, provides an improved process for manufacturing coated wire and a corona generating device produced thereby which fully satisfies the aspects of the invention hereinbefore set forth. While this invention has been described in conjunction with specific embodiments thereof, it will be understood that many alternatives, modifications and variations will be apparent to those skilled in the art. Accordingly, the present invention is intended to embrace all such alternatives, modifications, and variations as fall within the spirit and broad scope of the appended claims.

What is claimed is:

1. A corona discharge device having a coronode of the type including a wire composite including a core having a dielectric material and a coating layer of conductive material thereon.

2. The corona discharge device of claim 1, wherein said dielectric material includes glass.

3. The corona discharge device of claim 1, wherein said dielectric material includes glass fiber.

4. The corona discharge device of claim 1, wherein said conductive material includes metal.

5. The corona discharge device of claim 4, wherein said conductive material includes gold.

6. A corona discharge device useful in an electrostatic printing machine comprising a coronode having a wire composite including a core having a dielectric material and a coating layer of conductive material thereon.

7. A corona discharge device of claim 6, wherein said dielectric material includes glass.

8. A corona discharge device of claim 6, wherein said dielectric material includes glass fiber.

9. A corona discharge device of claim 6, wherein said conductive material includes metal.

10. A corona discharge device of claim 9, wherein said conductive material includes gold.

* * * * *